US008534986B2

(12) United States Patent
Borer et al.

(10) Patent No.: US 8,534,986 B2
(45) Date of Patent: Sep. 17, 2013

(54) BUNDLE INSERTION/EXTRACTION SYSTEM AND METHOD

(75) Inventors: Cyril John Borer, Allegany, NY (US); Jeffrey C. Edick, West Clarksville, NY (US); Stephen T. Walker, Olean, NY (US); David Suain, Portville, NY (US)

(73) Assignee: Dresser-Rand Company, Olean, NY (US)

( * ) Notice: Subject to any disclaimer, the term of this patent is extended or adjusted under 35 U.S.C. 154(b) by 558 days.

(21) Appl. No.: 12/861,600

(22) Filed: Aug. 23, 2010

(65) Prior Publication Data

US 2011/0052426 A1 Mar. 3, 2011

Related U.S. Application Data

(60) Provisional application No. 61/236,938, filed on Aug. 26, 2009.

(51) Int. Cl.

| | |
|---|---|
| ***F04D 29/60*** | (2006.01) |
| ***F01D 25/28*** | (2006.01) |
| *F01D 25/24* | (2006.01) |
| *B23P 19/10* | (2006.01) |

(52) U.S. Cl.
USPC ..... 415/1; 415/126; 415/213.1; 29/281.1; 29/700; 29/888.02

(58) Field of Classification Search
USPC ..... 415/1, 126, 213.1, 214.1, 220, 232; 29/281.1, 281.4, 700, 888.02, 888.021, 888.022, 29/888.023, 888.024, 888.025; 248/55, 671
See application file for complete search history.

(56) References Cited

U.S. PATENT DOCUMENTS 4,925,363 A * 5/1990 Brown et al. ..... 415/129
5,971,702 A * 10/1999 Afton et al. ..... 415/126

* cited by examiner

*Primary Examiner* — Edward Look
*Assistant Examiner* — Jason Davis
(74) *Attorney, Agent, or Firm* — Edmonds & Nolte, PC

(57) ABSTRACT

An insertion/extraction system and method for a compressor casing and a compressor bundle. The system includes a cradle extending from a first axial end of the compressor casing and configured to provide support for the compressor bundle during insertion, and an extension assembly coupled to a first axial end of the compressor bundle and extending therefrom into the compressor casing during insertion of the compressor bundle into the compressor casing, during extraction of the compressor bundle from the compressor casing, or both. The system further includes a support member that engages the extension assembly and the compressor casing to support the first axial end of the compressor bundle via the extension assembly, the support member configured to allow relative movement between the support member and the extension assembly during insertion of the compressor bundle into the compressor casing, extraction of the compressor bundle from the compressor casing, or both.

20 Claims, 19 Drawing Sheets

BUNDLE INSERTION/EXTRACTION SYSTEM AND METHOD

CROSS-REFERENCE TO RELATED APPLICATIONS

This application claims priority to U.S. patent application Ser. No. 61/236,938, which was filed Aug. 26, 2009. This priority application is hereby incorporated by reference in its entirety, to the extent that it is not inconsistent with the present disclosure.

BACKGROUND

In certain compressor systems, a casing is provided separate from the internal compression assembly, which is often referred to as a "bundle." The bundle typically includes the impellers, seals, balance pistons, and/or the like, while the casing may provide various fluid flow channels. The casing may be opened to receive the bundle in any number of ways, for example, radially and axially split casings may be employed. After the bundle is secured inside the casing, a top or side of the casing can be fastened to the rest of the casing, thereby closing the casing around the compression assembly.

In some configurations, one or both of the axial ends of the compressor casing may be opened to allow insertion and/or extraction of the bundle. The bundle may be inserted into or extracted from the casing through the open end. Often, supporting the bundle in the casing while the bundle is moved into or out of the casing is a challenge, since no external vertical support over the center of gravity is typically possible when the bundle is partially disposed in the casing. Accordingly, given the weight of the bundles of large industrial compressors, maintaining a precise alignment of bundle while it is fed axially into or removed from the casing presents a challenge. Thus, the bottom or top of the bundle often may contact the inside of the casing while the bundle slides into or out of the casing. This can cause galling or other types of damage to either or both of the inside of the casing and the bundle.

What is needed then is a system and method for supporting the bundle while it is inserted into or removed from the casing such that neither the bundle nor the casing is damaged.

SUMMARY

Embodiments of the disclosure may provide an insertion/extraction system for a compressor casing and a compressor bundle. The system includes a cradle extending from a first axial end of the compressor casing and configured to provide support for the compressor bundle during insertion. The system also includes an extension assembly coupled to a first axial end of the compressor bundle and extending therefrom into the compressor casing during insertion of the compressor bundle into the compressor casing, during extraction of the compressor bundle from the compressor casing, or both. The system further includes a support member that engages the extension assembly and the compressor casing so as to support the first axial end of the compressor bundle via the extension assembly, the support member configured to allow relative movement between the support member and the extension assembly during insertion of the compressor bundle into the compressor casing, extraction of the compressor bundle from the compressor casing, or both.

Embodiments of the disclosure may also provide a method for moving a compressor bundle relative to a compressor casing. The method includes aligning the compressor bundle with a service end of the compressor casing such that a non-service end of the compressor bundle faces the service end of the compressor casing. The method also includes supporting a service end of the compressor bundle with a cradle, and supporting the non-service end of the compressor bundle by engaging an extension assembly extending from the non-service end of the compressor bundle with a support member that engages the compressor casing. The exemplary method further includes sliding the compressor bundle in the cradle relative to the compressor casing and the support member.

Embodiments of the disclosure may further provide an exemplary modular compression system. The exemplary compression system includes a casing having first and second axial ends, and a centrifugal compressor bundle including a service end, a non-service end, and a plurality of compression stages disposed therebetween, the bundle configured to slide into the casing through the first axial end of the casing such that the non-service end is positioned proximal the second axial end of the casing. The exemplary compression system also includes a cradle coupled to the casing proximal the first axial end and extending away from the second axial end, the cradle configured to support at least the service end of the bundle during insertion, and a service end roller assembly coupled to the bundle proximal the service end, the service end roller assembly configured to roll in the cradle while supporting the bundle during insertion. The exemplary compression system further includes a rigid tubular body extending axially from the non-service end of the bundle, and a support member configured to engage the casing and the tubular body during insertion such that the tubular body is moveable relative the support member, the support member being configured to support the non-service end of the bundle to substantially prevent the bundle from sliding on an inside of the casing during insertion.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
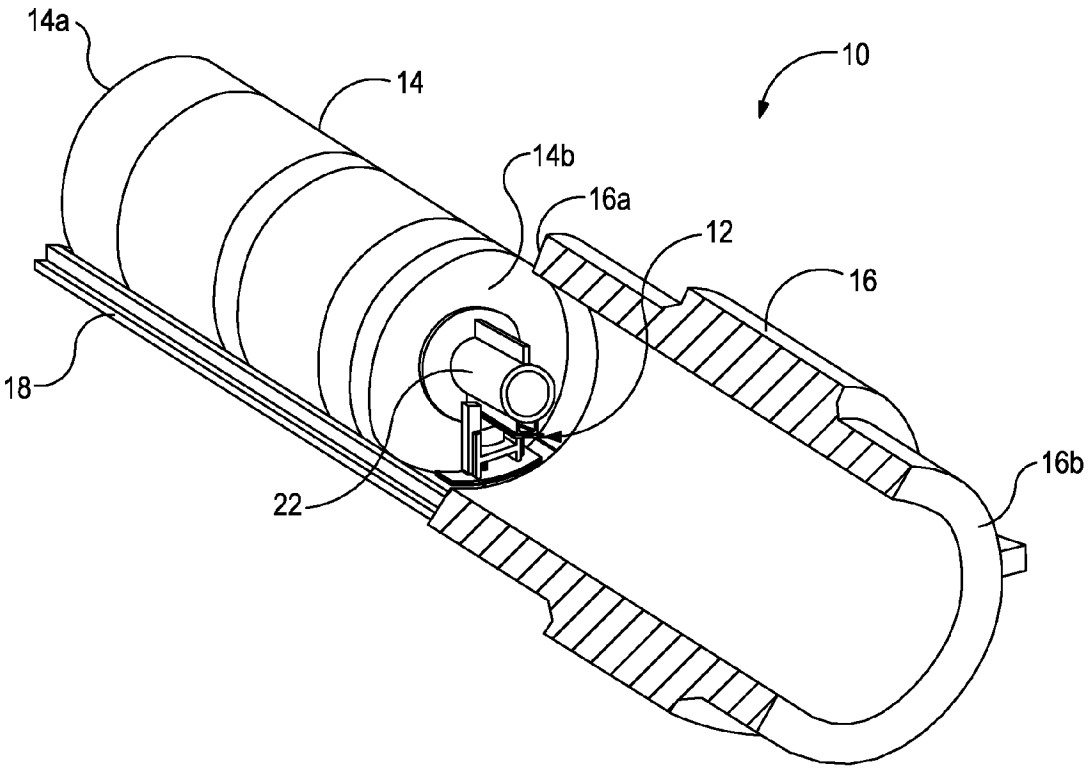
FIG. 1 is a partially cutaway perspective view of an exemplary compression system illustrating the bundle being inserted into the casing with an exemplary bundle insertion/extraction system, according to one or more aspects of the disclosure.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates a compression system 10, according to an exemplary embodiment. The compression system 10 generally includes a bundle 14 and a casing 16. In an exemplary embodiment, the bundle 14 is a modular bundle including one or more compression stages and the casing 16 is a compressor casing. The casing 16 may include first and second open axial ends 16*a*, 16*b*, which may also be referred to herein as service end 16*a* and non-service end 16*b*, respectively. The bundle 14 likewise includes first and second axial ends 14*a*, 14*b*, which may also be referred to as service end 14*a* and non-service end 14*b*, respectively. The bundle 14 is adapted to be inserted into the casing 16 such that the non-service end 14*b* of the bundle 14 proceeds through the service end 16*a* of the casing 16 until the non-service end 14*b* of the bundle 14 resides proximal the non-service end 16*b* of the casing 16 (i.e., service end 14*a* proximal service end 16*a* and non-service end 14*b* proximal non-service end 16*b*). Additionally, the bundle 14 is adapted to slide out of the casing 16 in the opposite direction.

A bundle insertion/extraction system may be provided to facilitate the insertion of the bundle 14 into the casing 16 and/or to facilitate the extraction of the bundle 14 from the casing 16. The insertion/extraction system may include a support member 12 that engages the casing 16 and an extension assembly 22 that engages the non-service end 14*b* of the bundle 14 and the support member 12, thereby supporting the non-service end 14*b* during insertion or extraction. The insertion/extraction system may also include a cradle 18 coupled to the service end 16*a* of the casing 16 and extending axially therefrom, away from the second axial end 16*b*. The cradle 18 supports the service end 14*a* of the bundle 14 during insertion or extraction and, together with the support member 12, maintains the alignment of the bundle 14 with the casing 16 to avoid damage to either component during relative movement.

Figure 2:
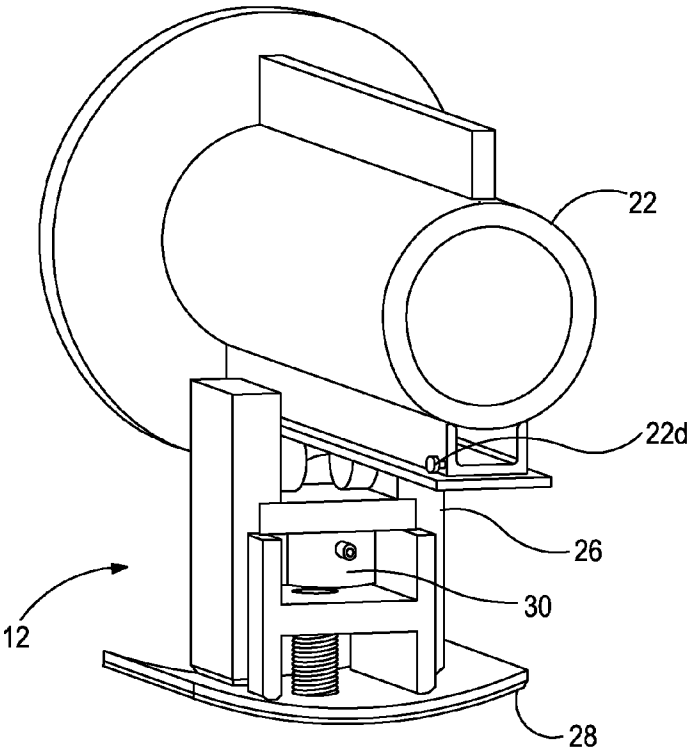
FIG. 2 is a perspective view of an exemplary support member and an exemplary extension assembly of the bundle insertion/extraction system, according to one or more aspects of the disclosure.
Figure 3:
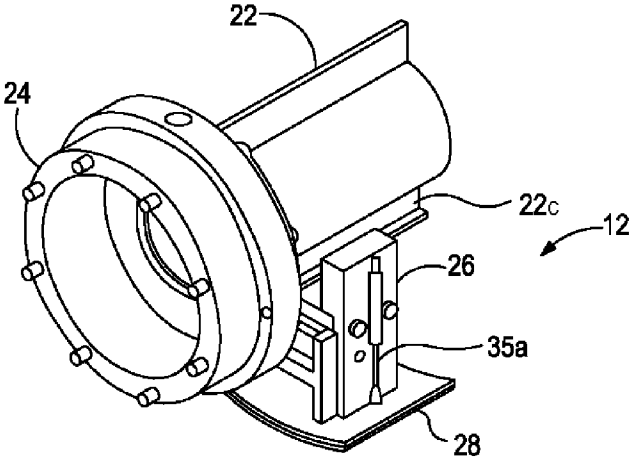
FIG. 3 is another perspective view of the support member and extension assembly, according to one or more aspects of the disclosure.
Figure 4:
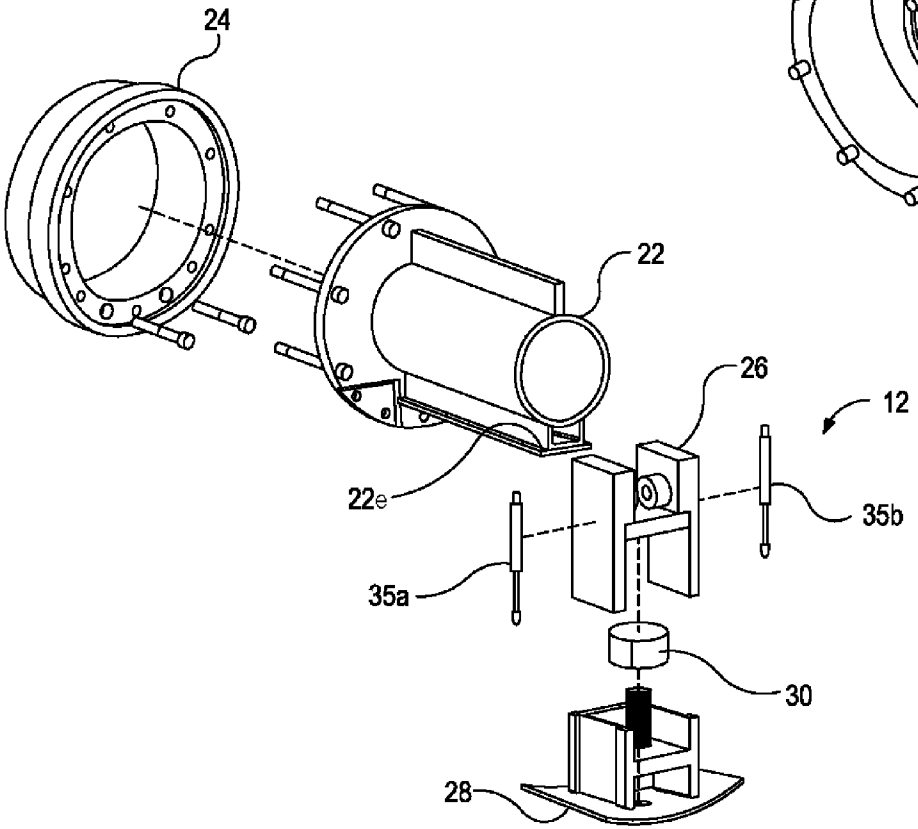
FIG. 4 is an exploded perspective view of the support member and the extension assembly, according to one or more aspects of the disclosure.

FIGS. 2-4 illustrate three views of the support member 12 and the extension assembly 22, according to one or more embodiments. Referring particularly to FIG. 2, the support member 12 generally includes a carrier assembly 26, a base assembly 28, and a cylinder 30, which may be a hydraulic cylinder, a pneumatic cylinder, or the like. The carrier assembly 26 engages the extension assembly 22, and is adapted to support the extension assembly 22. The base assembly 28 is engaged with the carrier assembly 26 and is adapted to engage an inside of the casing 16 (FIG. 1) to provide selective support of the bundle 14 during insertion and/or extraction thereof. The cylinder 30 is disposed at least partially between the carrier assembly 26 and the base assembly 28 and is adapted to engage both. As shown in FIGS. 3 and 4, tension springs 35*a,b* may also be coupled to and extend between the carrier assembly 26 and the base assembly 28 to ensure full actuation of the cylinder 30, as will be described in greater detail below.

Figure 5:
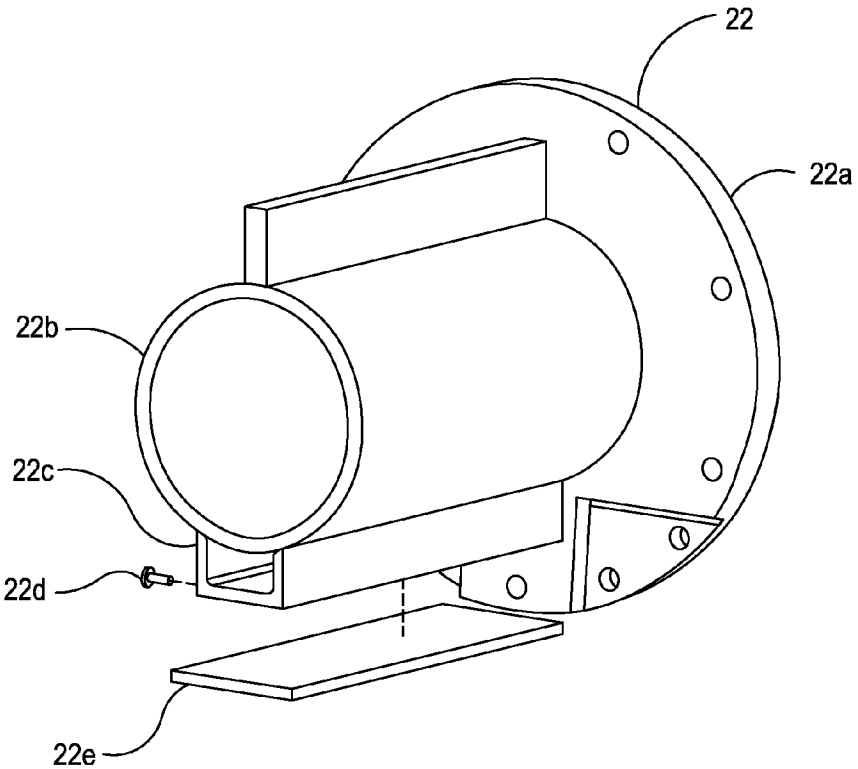
FIG. 5 is a partially-exploded view the extension assembly, according one or more aspects of the disclosure.

FIG. 5 illustrates a more-detailed and partially-exploded view of the extension assembly 22 of FIGS. 2-4, according to an exemplary embodiment. The extension assembly 22 includes a flange 22*a* and a rigid tubular body 22*b* extending longitudinally and horizontally therefrom and coupled thereto. In various embodiments, however, the flange 22*a* may be omitted and/or the tubular body 22*b* may have any suitable cross-sectional shape, such as square or rectangular.

The extension assembly 22 may also include a U-shaped bracket 22*c* coupled to the tubular body 22*b*, such that the open side of the "U" receives the tubular body 22*b*. The U-shaped bracket 22*c* may extend longitudinally along the tubular body 22*b*, for example, parallel thereto. A stop pin 22*d* or another type of fastener, shoulder, or the like may be coupled to the bracket 22*c*, proximal a distal end thereof, as shown. Further, a plate 22*e* may be coupled to the bottom side of the bracket 22*c*, extending horizontally therewith.

Figure 6:
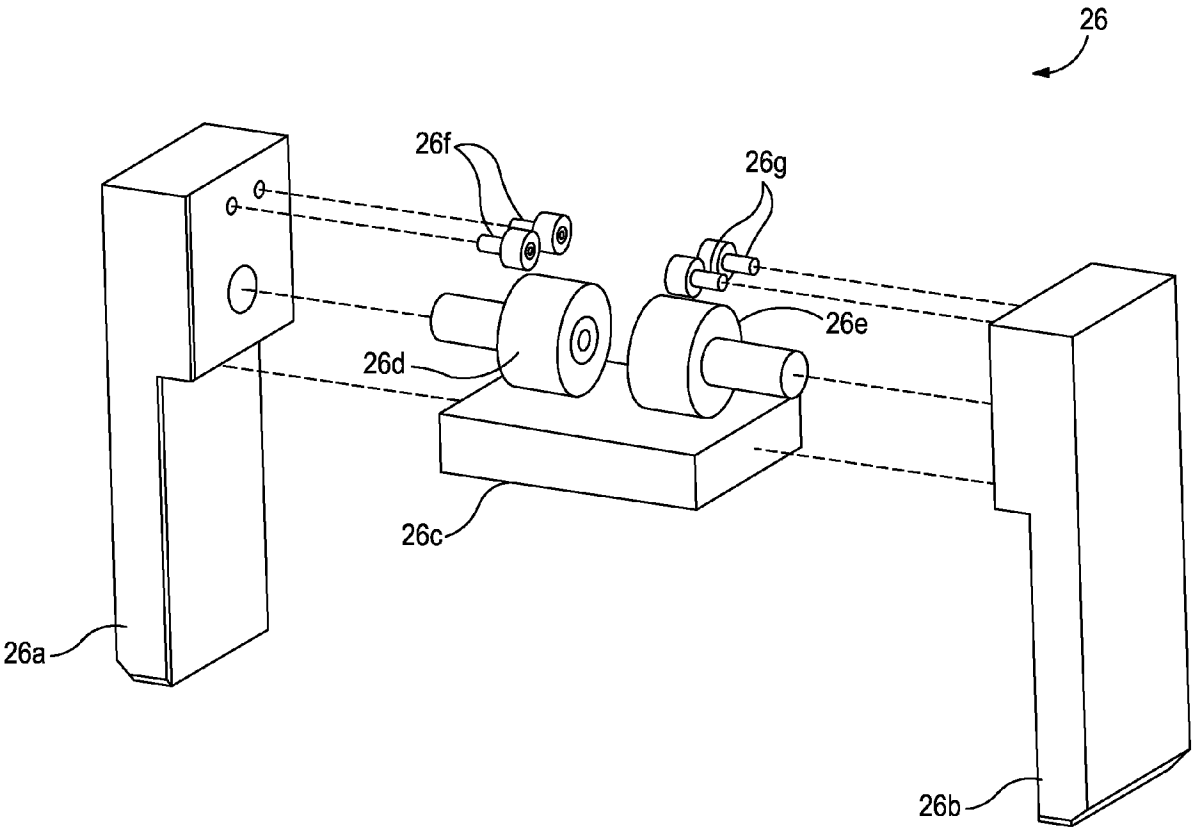
FIG. 6 is an exploded view of an exemplary carrier assembly of the support member, according to one or more aspects of the disclosure.

FIG. 6 illustrates a more-detailed and exploded view of the carrier assembly 26 of FIGS. 2-4, according to an exemplary embodiment. The carrier assembly 26 may include a pair of vertically-extending brackets 26*a* and 26*b* and a horizontally-extending plate 26*c* extending between and coupled thereto. The carrier assembly 26 may also include lower roller elements 26*d*, 26*e*, which may be coupled to the brackets 26*a*, 26*b*, respectively and may be spaced from the plate 26*c* to provide a clearance therebetween. In various other embodiments, however, the lower rollers 26*d,e*, may be substituted with wear plates, a low-friction planar structure, or the like, or may be simply omitted.

In an exemplary embodiment, the carrier assembly 26 also includes a pair of upper roller elements 26*f*, which may be coupled to the bracket 26*a* and vertically spaced from the lower roller element 26*d*. Likewise, a pair of upper roller elements 26*g* may be coupled to the bracket 26*b* and vertically spaced from the lower roller element 26*e*. As with the lower roller elements 26*d,e*, it will be appreciated that the upper roller elements 26*f,g* may be substituted with other suitable structures or may simply be omitted. Further, the extension assembly 22 may also include an annular spacer 24, for facilitating installation and/or removal of the extension assembly 22 through the non-service end 16*b* of the casing 16 (FIG. 1).

Referring now additionally to FIGS. 2-4, the interaction of the extension assembly 22 and the carrier assembly 26 of the support member 12, according to an exemplary embodiment, can be appreciated. The plate 22*e* of the extension assembly 22 extends between the lower roller element 29*d* and the pair of upper roller elements 26*f* on one side of the U-shaped bracket 22*c* and between the lower roller element 26*e* and the pair 26*g* of upper roller elements on the other side of the bracket 22*c*. Stop bolts (not shown) may extend through the brackets 26*a,b* to secure the brackets 26*a,b* to one or both of the bracket 22*c* and the plate 22*e*, thereby temporarily preventing relative movement between the extension and carrier assemblies 22 and 26.

Figure 7:
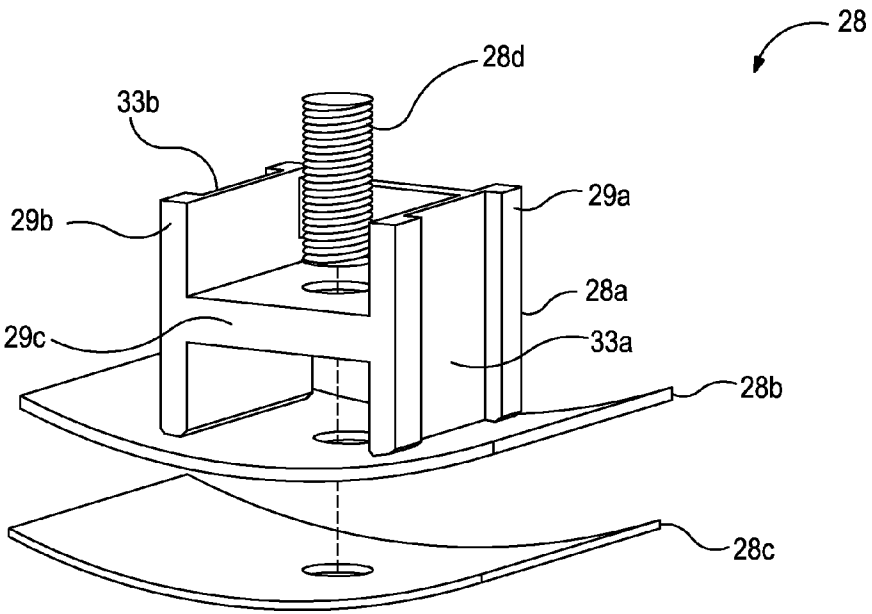
FIG. 7 is a partially-exploded view of an exemplary base assembly of the support member, according to one or more aspects of the disclosure.

FIG. 7 illustrates a more-detailed and partially-exploded view of the base assembly 28 of FIGS. 2-4, according to an exemplary embodiment. The exemplary base assembly 28 may include an H-shaped bracket 28*a* having two sides 29*a,b*, and a cross member 29*c* extending therebetween. As shown, the cross member 29*c* may extend perpendicularly to the sides 29*a,b*, but in other embodiments, the cross member 29*c* may be angled with respect thereto to form a truss or the like. The base assembly 28 may also include an arcuate member 28*b* coupled to the bottom of the H-shaped bracket 28*a*, and a liner 28*c* coupled to the bottom side of the arcuate member 28*b*. The base assembly 28 may also include a threaded rod 28*d*, which extends vertically through the cross member 29*c*. In an exemplary embodiment, the rod 28*d* may be permitted to extend through the arcuate member 28*b* and the liner 28*c*; however, in other exemplary embodiments, the rod 28*d* may stop and bear against the arcuate member 28*b*.

In an exemplary embodiment, the arcuate member 28*b* may be complementarily shaped or radiused so as mate with the inside of the casing 16 (FIG. 1). Furthermore, in an exemplary embodiment, the liner 28*c* is disposed between the arcuate member 28 and the inside of the casing 16 may be formed of one or more materials that are significantly softer than the casing 16, for example, plastic, nylon, rubber, elastomers, soft metals, combinations thereof, or the like. Accordingly, the liner 28*c* may ensure than the casing 16 is not damaged by movement of the arcuate member 28*b*. In various exemplary embodiments, however, the liner 28*c* may be omitted or substituted with other structures such as rollers to further facilitate movement in the casing 16. In embodiments including the liner 28*c*, the arcuate member 28*b* may still be described as engaging the inside of the casing 16. It will be appreciated that, in doing so, the arcuate member 28*b* also engages the liner 28*c* that is interposed between the arcuate member 28*b* and the inside of the casing 16. Moreover, the H-shaped bracket 28*a* may include vertically-extending channels 33*a* and 33*b* on either side 29*a,b* thereof, which receive the brackets 26*a,b* (FIG. 6), respectively, so that the carrier assembly 26 can slide vertically with respect to the base assembly 28. Although not shown, in various embodiments, one or more rollers, wear plates, or other structures or devices can be disposed in the channels 33*a,b* to facilitating the vertical movement of the carrier assembly 26 with respect to the base assembly 28.

Figure 8:
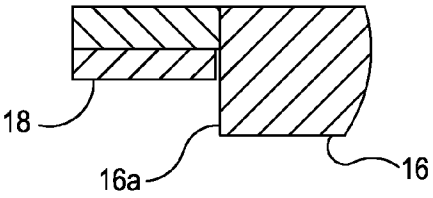
FIG. 8 is a partial cross-sectional view of an exemplary cradle of the bundle insertion/extraction system engaged with the casing, according to one or more aspects of the disclosure.

FIG. 8 illustrates an end of the cradle 18 coupled to the service end 16*a* of the casing 16. This coupling may be effected prior to inserting the bundle 14 (FIG. 1) into the casing 16, to allow the cradle 18 to support the bundle 14. The cradle 18 may be coupled to the casing 16 using any suitable mechanism, device, and/or process such that the cradle 18 is capable of supporting the weight of the bundle 14 and is removable once insertion or extraction is complete. In other embodiments, the cradle 18 may not be coupled to the service end 16*a* of the casing 16 at all, but may be held in place by external support structures. Furthermore, although the cradle 18 is illustrated as coupled directly to axial face of the service end 16*a* of the casing 16, it will be appreciated that the cradle may be coupled to other areas on the casing 16.

Figure 9:
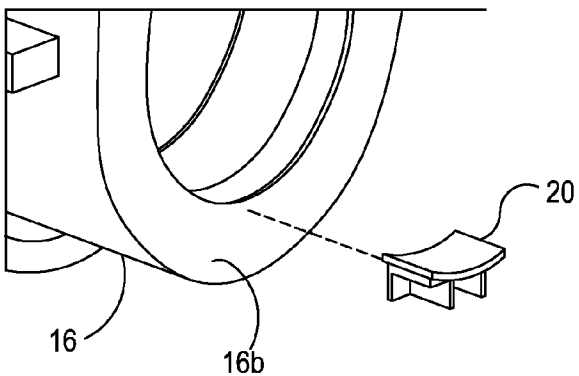
FIG. 9 is an exploded perspective view of an exemplary case extension of the bundle insertion/extraction system engaging the casing, according to one or more aspects of the disclosure.

FIG. 9 illustrates the casing extension 20 is coupled to a non-service end 16*b* of the casing 16. Similarly, as described above with respect to the cradle 18, the casing extension 20 may be coupled to other areas of the casing 16, may be coupled to the casing 16 using any suitable mechanism, device, and/or process, or may not be coupled to the casing 16 at all, but rather held in place by external support structures (not shown).

Figure 10:
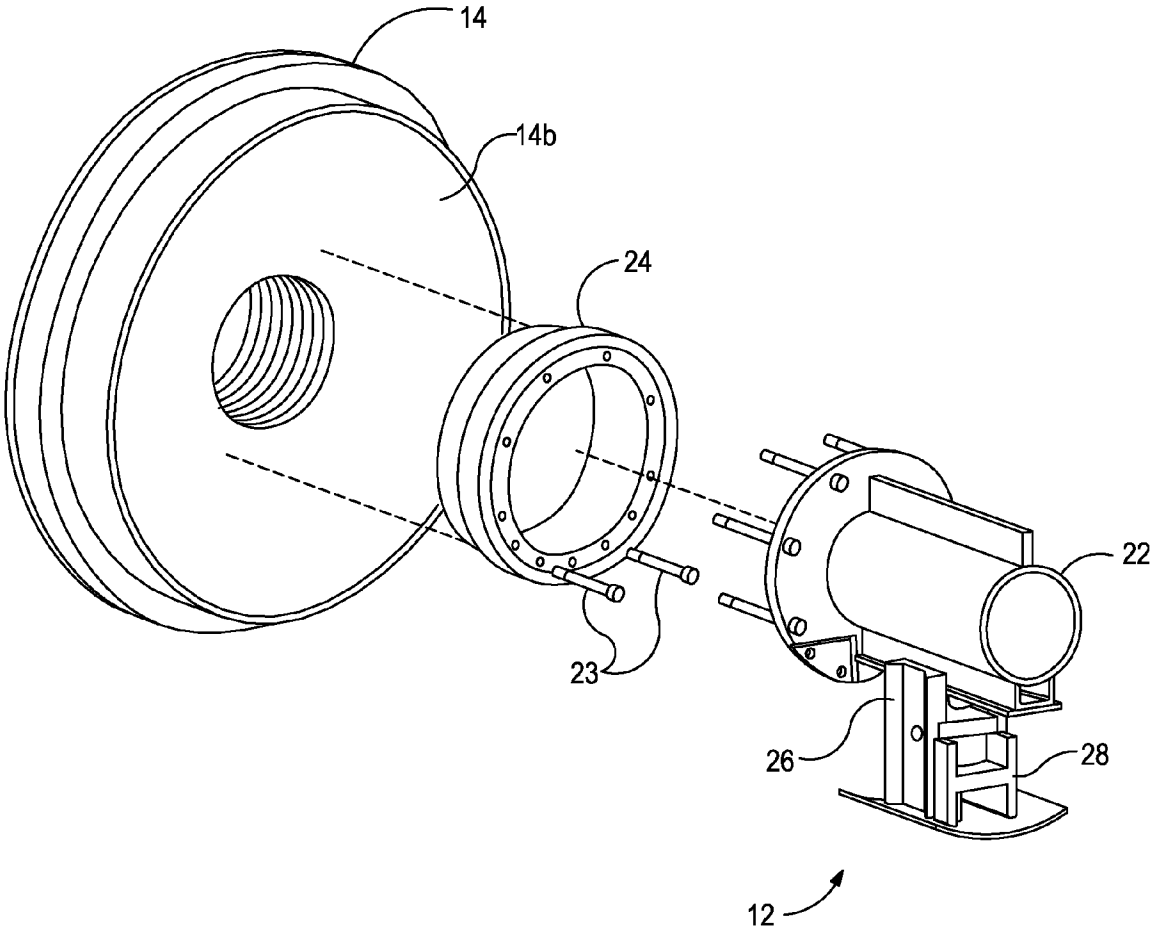
FIG. 10 is a partially-exploded perspective view of the extension assembly, the support member, and the non-service end of the bundle, according to one or more aspects of the disclosure.

FIG. 10 illustrates the extension assembly 22 coupled to the non-service end 14*b* of the bundle 14 by fastening or otherwise securing the spacer 24 to the non-service end 14*b*. It will be appreciated, however, that the spacer 24 may be omitted in some exemplary embodiments, such that the flange 22*a* of the extension assembly 22 is directly coupled to the bundle 14. In other exemplary embodiments, the flange 22*a* may be omitted and the extension assembly 22 may be coupled to the bundle 14 in any suitable manner. The extension assembly 10 may also include one or more stop pins 23, which may provide an end range for relative movement of the carrier assembly 26 and the extension assembly 22.

Figure 11:
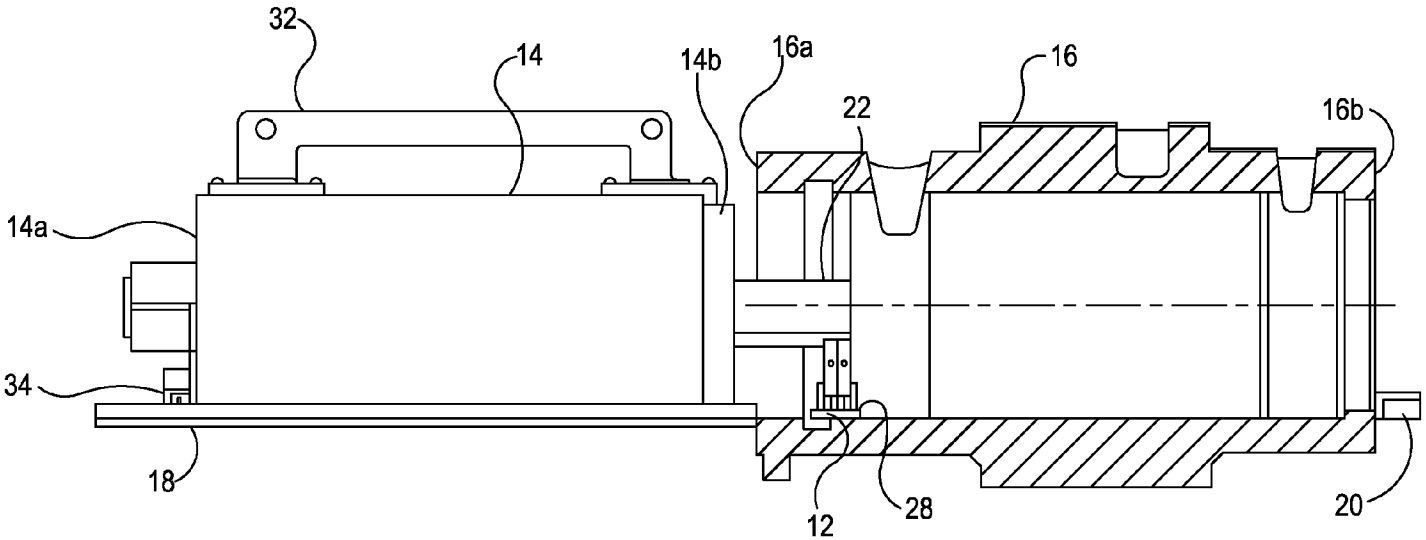
FIG. 11 is a partially broken away elevation view of the bundle inserted into the casing with the bundle insertion/extraction system, according to one or more aspects of the disclosure.
Figure 12:
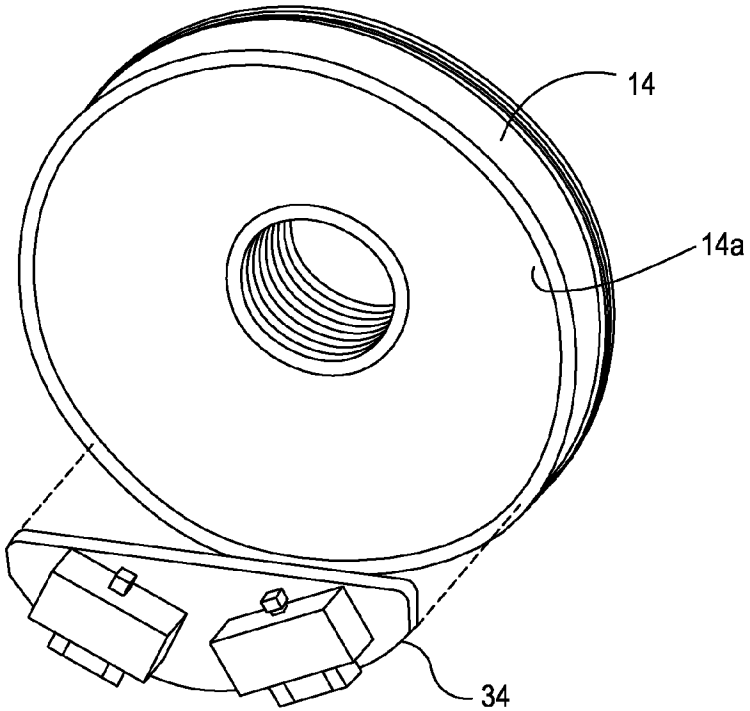
FIG. 12 is a partially-exploded perspective view of an exemplary service end roller assembly of the bundle insertion/extraction system engaged with the service end of the bundle, according to one or more aspects of the disclosure.

FIG. 11 illustrates the bundle 14 and the support member 12, which may be lifted with a lifter 32 and inserted into the casing 16 until stopped by the lifter 32. The lifter 32 may be hydraulic, pneumatic, mechanical or any other type of device suitable. As also shown in FIG. 11, but best illustrated FIG. 12, a service end roller assembly 34 may be coupled to the service end 14*a* of the bundle 14. In an exemplary embodiment, during insertion of the bundle 14, the service end roller assembly 34 rolls along the cradle 18.

Referring now to FIG. 3 and FIG. 11, in an exemplary embodiment, the carrier and base assemblies 26, 28 are able slide away from the non-service end 14*b* of the bundle 14, while the extension assembly 22 remains stationary, until the carrier assembly 26 contacts the stop pin or fastener 22*d*. This sliding movement of the carrier and base assemblies 26 and 28 and the cylinder 30 is relative to the bundle 14 and the casing 16.

Referring additionally to FIGS. 4-6, once the carrier assembly 26 engages the stop pin 22*d*, the support member 12 has reached one end of a stroke length, although it will be appreciated that the movement of the carrier assembly 22 may be stopped prior to engaging the stop pin 22*d* or may be stopped by other structures (not shown). The cylinder 30 may then expand, with full extension ensured by traction springs 35*a,b*, for example, such that the threaded rod 28*d* is adjusted to bottom the base assembly 28 against the inside of the casing 16. By expanding of the cylinder 30, engaging the carrier assembly 26 with the extension assembly 22 that is coupled to the bundle 14, and engaging the base assembly 28 with the casing 16, the non-service end 14*b* of the bundle 14 is raised. This may allow for centering the bundle 14 on the casing 16.

At this point, the plate 22*e* (FIG. 5) may contact and be partially supported by one or more of the lower roller elements 29*a,b* (FIG. 6). The non-service end 14*b* of the bundle 14 is thus supported by the extension assembly 22 and the support member 12. Accordingly, the bundle 14 does not contact, or at least does not apply damaging load against, the inside wall of the casing 16 when it is raised.

The bundle 14 is then pushed farther into the casing 16 with, for example, a hydraulic pusher (not shown), which can be any suitable hydraulic, pneumatic, or mechanical device. During this pushing, the extension assembly 22, supported by the support member 12, moves on the carrier assembly 28, relative thereto and, more importantly, relative to the casing 16. For example, the extension assembly 22 rolls on the lower roller elements 29*a,b* during pushing.

The pushing of the bundle 14 and thus the extension assembly 22 is continued for a movement increment until the relative movement of the extension assembly 22 and the carrier assembly 26 is arrested, for example, by stop pins 23 (FIG. 10) or by the carrier assembly 26 abutting the flange 22*a*. The maximum amount of relative movement between the carrier assembly 26 and the extension assembly 22 may be referred to as the maximum stroke length. In an exemplary embodiment, the maximum stroke length may be the length of the plate 22*e*. In an exemplary embodiment, the maximum stroke length may be defined by the distance between the stop pin 22*d* and the flange 22*a* (FIG. 5), for example, from one end of the stroke where the stop pin 22*d* engages the carrier assembly 26 to another end of the stroke where the carrier assembly 26 engages the flange 22*a*. However, other components of the extension assembly 22 may define the stroke length. Further, in various intended operations, the relative movement may be stopped at any time by the operator according to factors such as movement duration, distance, or other factors, and need not be arrested by abutment of any structures.

After the bundle 14 and the extension assembly 22 have moved a desired increment or stroke length, the cylinder 30 is contracted, for example, by releasing pressure from therein, and the carrier assembly 26 is permitted to slide downward relative to the base assembly 28, thereby gently "dropping" the bundle 14. The non-service end 14*b* of the bundle 14 may rest on the inside of the casing 14, or may be supported in cantilever fashion by a V-block or other suitable device disposed on the cradle 18, or by the cradle 18 itself and/or the service end roller assembly 34. With pressure released from the carrier and base assemblies 26, 28, the carrier and base assemblies 26, 28 may be moved away from the non-service end 14*b* of the bundle 14, while the extension assembly 22 remains stationary, thereby moving the carrier assembly 26 to the opposite end of the stroke. During this relative movement, in an exemplary embodiment, the upper roller elements 26*f,g* roll along the plate 22*e*.

Figure 13:
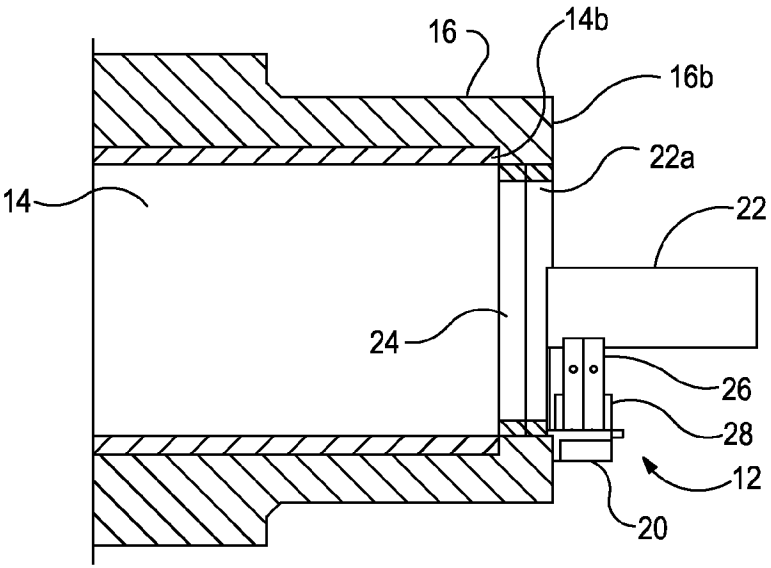
FIG. 13 is a partial cross-sectional view of the bundle fully-inserted into the casing, and the support member engaged with the case extension, according to one or more aspects of the disclosure.

The process of pushing the bundle 14 and then releasing the pressure on the cylinder 30 and moving the carrier and base assemblies 26, 28 relative to the extension assembly 22 may be repeated to "walk" the bundle 14 into the casing 16 by stroke length increments. Accordingly, the bundle 14 may be incrementally inserted into the casing 16 until base assembly 28 engages the case extension 20, allowing for a final stroke to complete the insertion of the bundle 14, as shown in FIG. 13.

As a result of this operation of the insertion/extraction assembly 12, bundle-to-casing contact, and thus galling, during the insertion of the bundle 14 into the casing 16 is substantially eliminated. Further, rolling on the interior of the casing 16 is avoided, and only relatively soft material (such as the plastic and/or nylon of the liner 28*c*) contacts the casing 16 during the insertion.

To extract the bundle 14 from the casing 16, in an exemplary embodiment, the cradle 18 is engaged with the service end 16*a* of the casing 16, and the case extension 20 is engaged with the non-service end 16*b* of the casing. The service end roller assembly 34 is coupled to the service end 14*a* of the bundle 14. The insertion/extraction system 12 is coupled to the non-service end 14*b* of the bundle 14 by coupling the flange 22*a* of the extension assembly 22 to the non-service end 14*b*. The support member 12 is supported by the case extension 20.

The carrier assembly 26, the base assembly 28 and the cylinder 30, all of which are engaged with each other in some form, may slide toward the non-service end 14*b* of the bundle 14 until the carrier assembly 26 and/or the base assembly 28 contacts the flange 22*a* of the extension assembly 22, for example. This sliding movement of the carrier and base subassemblies 26 and 28 and the cylinder 30 is relative to the bundle 14, the casing 16, and the extension assembly 22 of the support member 12. Using the cylinder 30, the non-service end 14*b* of the bundle 14 is then raised to keep the bundle 14 centered with respect to the casing 16. At this point, the plate 22*e* contacts and/or is partially supported by one or more of the lower roller elements 29*a,b*. The non-service end 14*b* is supported by the support member 12, and the service end 14*a* of the bundle 14 is supported by the service end roller assembly 34 and the cradle 18. The bundle 14 does not contact, or at least does not apply a damaging load against, the inside of the casing 16 when raised by the support member 12. The bundle 14 is then pulled out of the casing 16 by a stroke length with, for example, a puller (not shown), which may be pneumatic, hydraulic, mechanical, or any other suitable device.

During this pulling, the extension assembly 22 is supported by the cylinder 30 and the carrier and base subassemblies 26 and 28, with the extension assembly 22 rolling on the lower roller elements 26*d,e*. The pulling of the bundle 14 and thus the extension assembly 22 is continued for one stroke increment, as described above during insertion, but in the reverse direction. After the bundle 14 and the extension assembly 22 have moved in an increment less than or equal to the maximum stroke length, the cylinder 30 is contracted and the carrier assembly 26 is thus permitted to slide downward (La, "dropped") relative to the base assembly 28, thereby permitting relative movement between the extension assembly 22 and the carrier and base assemblies 26 and 28. During this relative movement, in an exemplary embodiment, the lower roller elements 26*e,f* roll along the plate 22*e*. The expanding of the cylinder 30, pulling the bundle 14 by a stroke length, contracting the cylinder 30, and moving the carrier and base assemblies 26, 28 may be repeated to "walk" the bundle 14 out of the casing 16.

Figure 14:
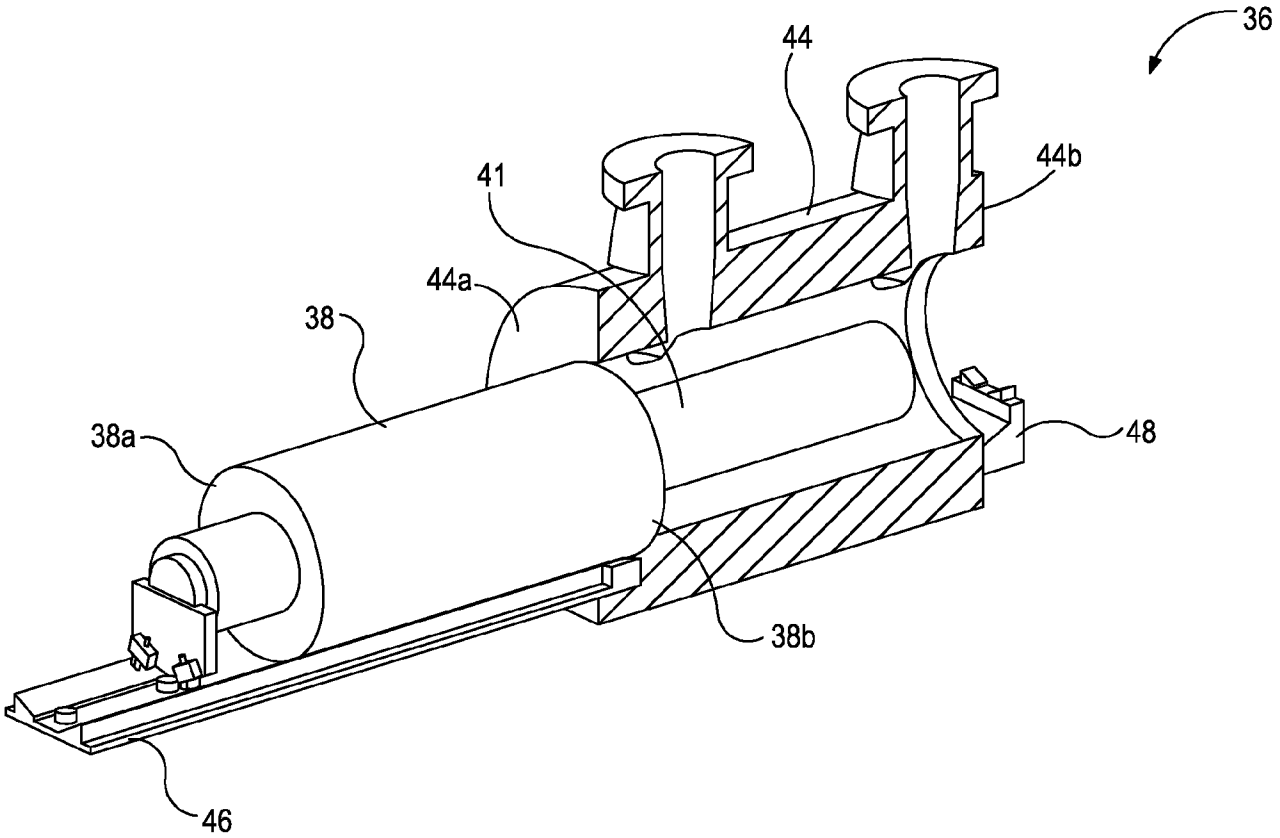
FIG. 14 is a partially cutaway perspective view of a compression system including a bundle, a casing, and another exemplary embodiment of a bundle insertion/extraction system, according to one or more aspects of the disclosure.

FIG. 14 illustrates another compression system 36, according to an exemplary embodiment. The compression system 36 generally includes a bundle 38 having a first axial or "service" end 38*a* and a second axial or "non-service" end 38*b*. The compression system 36 further includes a casing 44 having first axial or "service" end 44*a* and a second axial or "non-service" end 44*b*. In an exemplary embodiment, the bundle 38 is a modular bundle and the casing 44 is a compressor casing, and the modular bundle and the compressor casing form part of a compressor such as, for example, a centrifugal or radial compressor. The bundle 38 is adapted to be inserted into the casing 44 through the service end 44*a* thereof such that the service ends 38*a*, 44*a* and the non-service ends 38*b*, 44*b* align. The bundle 38 is further adapted to be extracted from the casing 44 through the service end 44*a* of the casing 44.

A bundle insertion/extraction system may be provided to facilitate the insertion of the bundle 38 into and/or extraction of the bundle 38 out of the casing 44. The bundle insertion/extraction system may include an extension assembly 41, a cradle 46 that supports at least the service end 38*a* of the bundle 38 during insertion and/or extraction, and a support member 48 that supports the non-service end 38*b* of the bundle 38 during insertion and/or extraction. The cradle 46 may be coupled to the casing 44, for example, fastened to the service end 44*a*. In various exemplary embodiments, the cradle 46 may be coupled to the casing 44 using any suitable mechanism, device, and/or process or may not be coupled to the casing 44, instead being held in place by external supporting structures (not shown). In an exemplary embodiment, the extension assembly 41 is coupled to the bundle 38 and the support member 48 is coupled to the casing 44 proximal the non-service end 44*b*, for example, outside of the casing 44.

Figure 15:
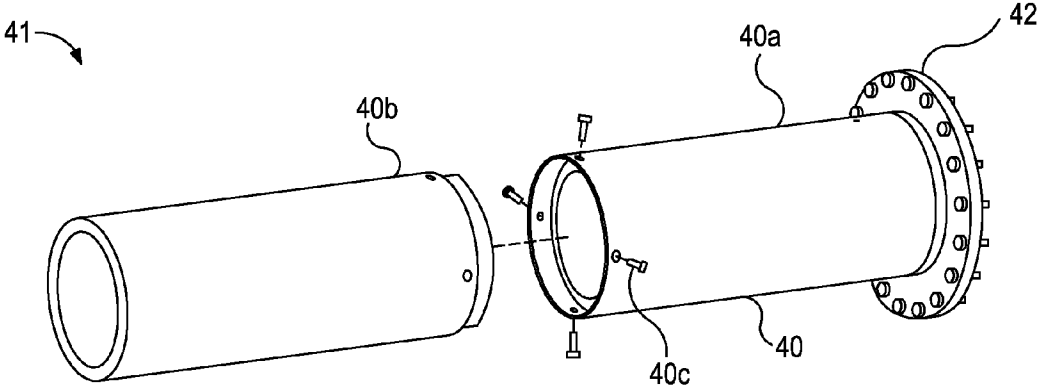
FIG. 15 is an exploded perspective view of an exemplary extension assembly of the bundle insertion/extraction system of FIG. 14, according to one or more aspects of the disclosure.
Figure 17:
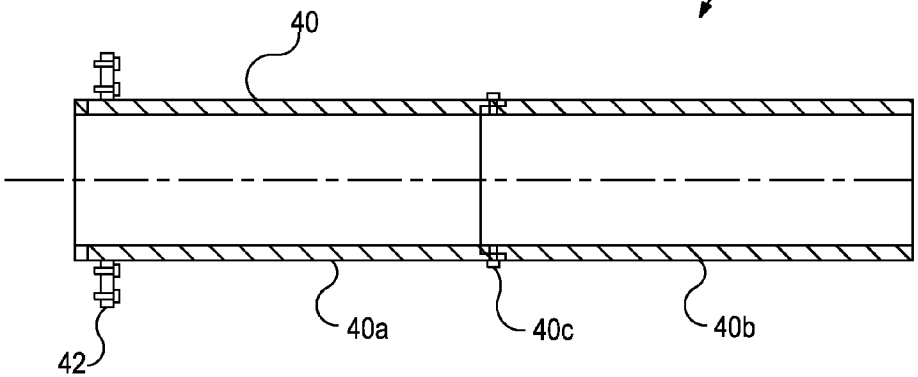
FIG. 17 is a sectional view of the extension assembly of FIG. 16, taken along line 17-17.
Figure 16:
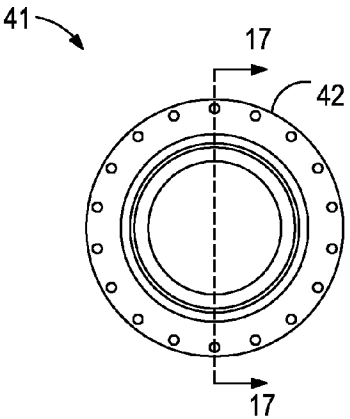
FIG. 16 is an end view of the extension assembly of FIG. 15, according to one or more aspects of the disclosure.

FIGS. 15-17 illustrate three views of the extension assembly 41, according to one or more exemplary embodiments. The extension assembly 41 includes a rigid tubular body 40 and a flange 42. The flange 42 may be releasably coupled, for example, fastened, to the non-service end 38*b* of the bundle 38. The tubular body 40 may be coupled to the flange 42 and may extend longitudinally therefrom as shown. In other embodiments, however, the flange 42 may be omitted. Further, the tubular body 40 may include a plurality of tubular segments (two are shown: 40*a*, 40*b*). The tubular segments 40, 40*b* may be releasably coupled together, for example, using fasteners 40*c*, as shown. Further, the extension assembly 41 may have a length that is slightly shorter, as long, or longer than the axial length of the casing 44 (FIG. 14), such that the extension assembly 41 extends through the non-service end 44*b* of the casing 44 during insertion and/or extraction of the bundle 38.

Figure 18:
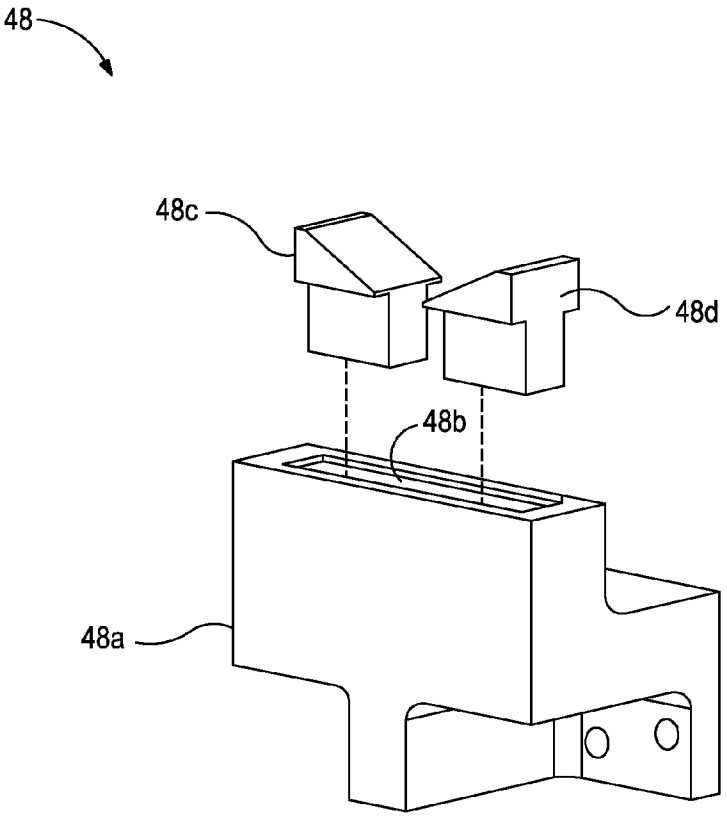
FIG. 18 is an exploded perspective view of the support member of FIG. 14, according to one or more aspects of the disclosure.

FIG. 18 illustrates an exploded view of the support member 48, according to an exemplary embodiment. According to one example among many contemplated herein, the support member 48 may be a first adjustable V-block assembly 48. In other embodiments, however, the support member 48 may be or include any other suitable structures and may include any number of rollers. The first V-block assembly 48 includes a base block 48*a*, a channel 48*b* formed in the base block 48*a*, and V-blocks 48*c* and 48*d*, the lower portions of which extend into the channel 48*b*. The first V-block assembly 48 may be adjusted by moving the V-blocks 48*c,d* horizontally within the channel 48*b*. This permits adjustment of the vertical and horizontal position of any object supported by the V-blocks 48*c,d*, such as the bundle 38. Although not shown, the V-blocks 48*c,d* may be movably constrained in the slot 48*b* using any suitable devices or processes such as a dovetail connection, bolts, rivets, welding, brazing, mechanical resistance fits, combinations thereof, and/or the like.

Figure 19:
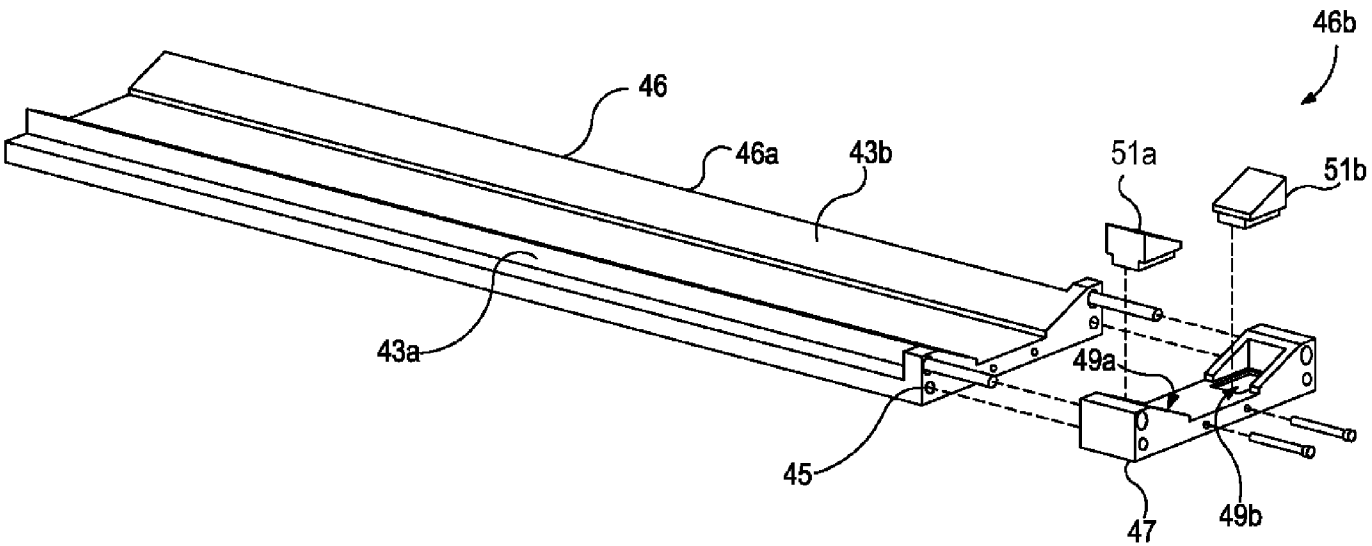
FIG. 19 is an exploded perspective view of the cradle of FIG. 14, according to one or more aspects of the disclosure.

FIG. 19 illustrates the cradle 46, according to one or more embodiments. The cradle 46 includes a cradle body 46*a* which may have wedge-shaped sides 43*a,b* to reduce any lateral movement of the bundle 38 (FIG. 14) during insertion. The cradle 46 may also include a second support block 46*b*, which, in an exemplary embodiment, may be a second adjustable V-block assembly 46*b*.

The second adjustable V-block assembly 46*b* may be coupled to an end 45 of the cradle body 46*a*, proximal the service end 44*a* of the casing 44 (FIG. 14). The second adjustable V-block assembly 46*b* includes a base 47, slots 49*a,b* formed in the base 47, and V-blocks 51*a,b*, the lower portions of which extend into the slots 49*a,b*, respectively. The second V-block assembly 46*b* is may be adjusted by moving the V-blocks 51*a,b* horizontally within the slots 49*a,b*, respectively. This may allow adjustment of the vertical and horizontal position of any the bundle 38 (FIG. 14) when it is supported by the second V-block assembly 46*b*. In an exemplary embodiment, instead of being coupled to the cradle body 46*a*, the second adjustable V-block assembly 46*b* may be integral with the cradle body 46*a*.

Figure 20:
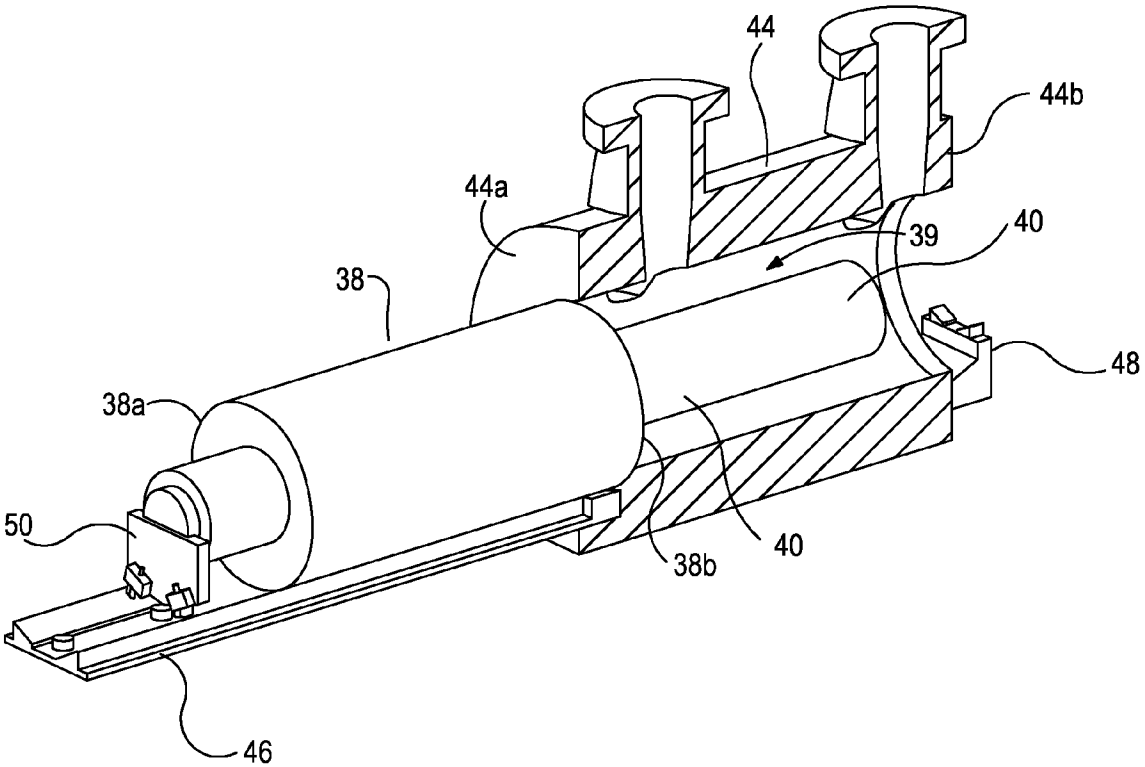
FIG. 20 is a partially cutaway perspective view of the bundle partially inserted into the casing with the exemplary bundle insertion/extraction system of FIG. 14, according to one or more aspects of the disclosure.
Figure 21:
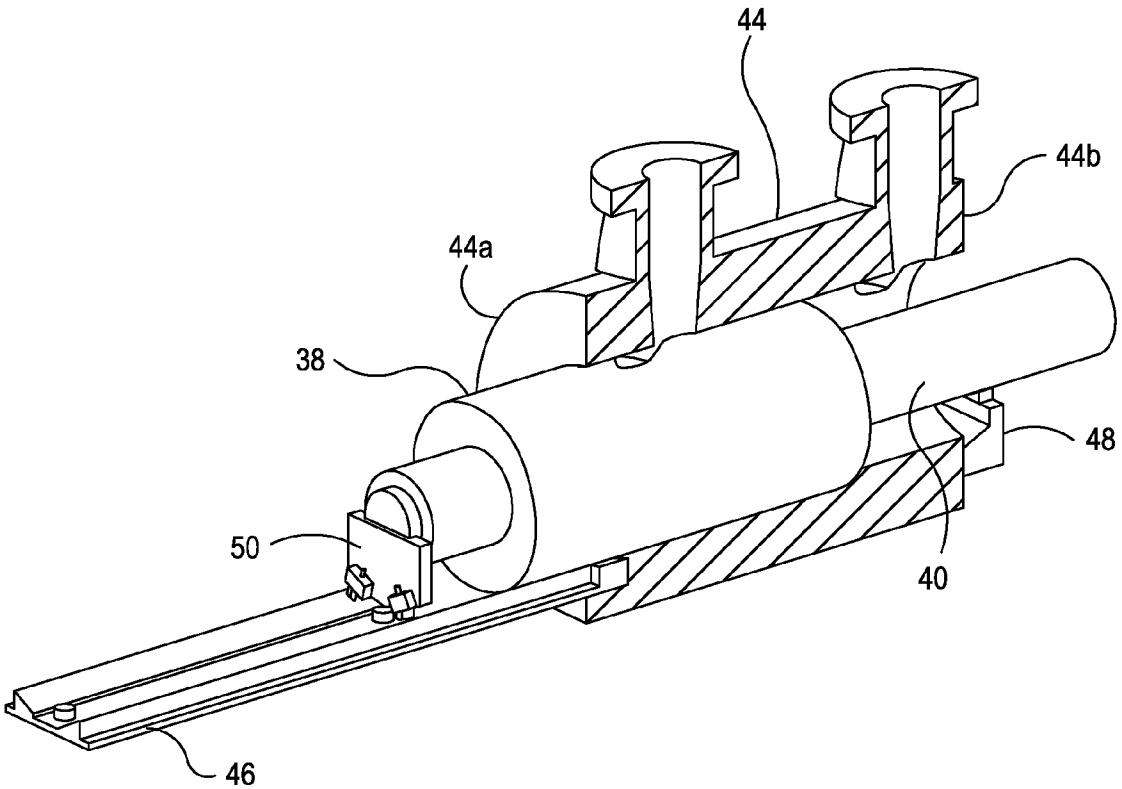
FIG. 21 is a view similar to that of FIG. 20, depicting the bundle inserted farther into the casing using the bundle insertion/extraction system of FIG. 14, according to one or more aspects of the disclosure.
Figure 22:
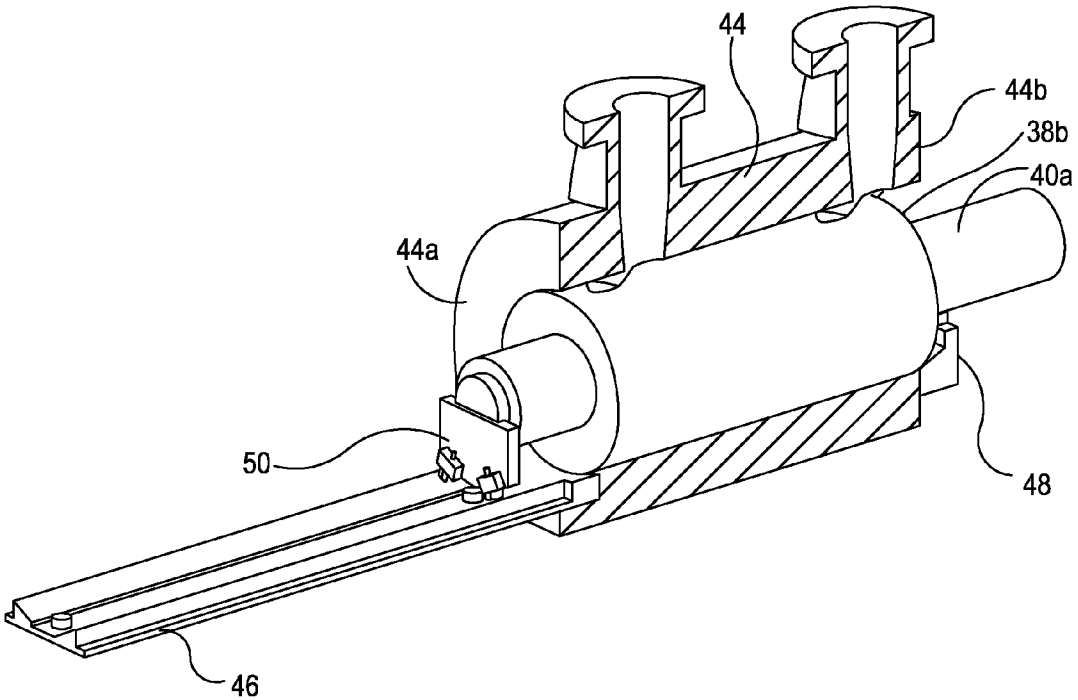
FIG. 22 is a view similar to that of FIGS. 20 and 21, depicting the bundle completely inserted into the casing using the bundle insertion/extraction system of FIG. 14, according to one or more aspects of the disclosure.

FIGS. 20-22 illustrate an incremental progression of inserting the bundle 38 into the casing 44 using the insertion/extraction system, according to an exemplary embodiment. To insert the bundle 38 into the casing 44, a service end roller assembly 50 is coupled to the service end 38*a* of the bundle 38, and the cradle 46 is engaged with the service end 44*a* of the casing 44 so that the second V-block assembly 46*b* of the cradle 46 is adjacent the service end 44*a*. The bundle 38 is supported by the service end roller assembly 50 and the cradle body 46*a* proximal the service end 38*a*, and by the second V-block assembly 46*b* (FIG. 19) proximal the non-service end 38*b*. The extension assembly 41 extends into the casing 44, as shown in FIG. 25.

Proceeding from the orientation shown in FIG. 20 to that shown in FIG. 21, the bundle 38 is pushed into the casing 44, for example, using a hydraulic pusher (not shown). During the pushing, the second adjustable V-block assembly 46*b* (FIG. 19) provides clearance between the bundle 38 and the inside of the casing 44. At some point during the pushing, the tubular body 40 of the extension assembly 41 is supported by the support member 48, as shown in FIG. 26, and the service end 38*a* of the bundle 38 is supported by the service end roller assembly 50.

Proceeding to FIG. 22, as the bundle 38 is pushed and thus inserted farther into the casing 44, the tubular body 40 of the extension assembly 41 is supported by the support member 48 located proximal the second axial end 44*b* of the casing 44 and one of the tubular segments 40*b* is decoupled from the tubular segment 40*a* to limit the extent of the structure extending through the casing 44 and potentially interfering with other equipment or structures in the surrounding area. As a result of this operation of the compression system 36, bundle-to-casing contact during the insertion of the bundle 38 into the casing 44 is eliminated, and no rolling occurs on the casing 44.

To extract the bundle 38 from the casing 44, in an exemplary embodiment, the support member 48 is coupled to the non-service end 44*b* of the casing 44, the extension assembly 39 is coupled to the non-service end 38*b* of the bundle 38, and the service end roller assembly 50 is coupled to the service end 38*a* of the bundle 38. The bundle 38 is then pulled out of the casing 44, using a hydraulic puller (now shown) or the like, while being supported by the engagement between the service end roller assembly 50 and the cradle 46, and the engagement between the support member 48 and the extension assembly 39. At some point during the pulling of the bundle 38, the bundle 38 is supported by the engagement between the service end roller assembly 50 and the cradle 46, and the engagement between the support member 48 and the segment 42. As a result, the bundle-to-casing contact during the extraction of the bundle 38 from the casing 44 is eliminated and no rolling occurs on the casing 44.

Figure 23:
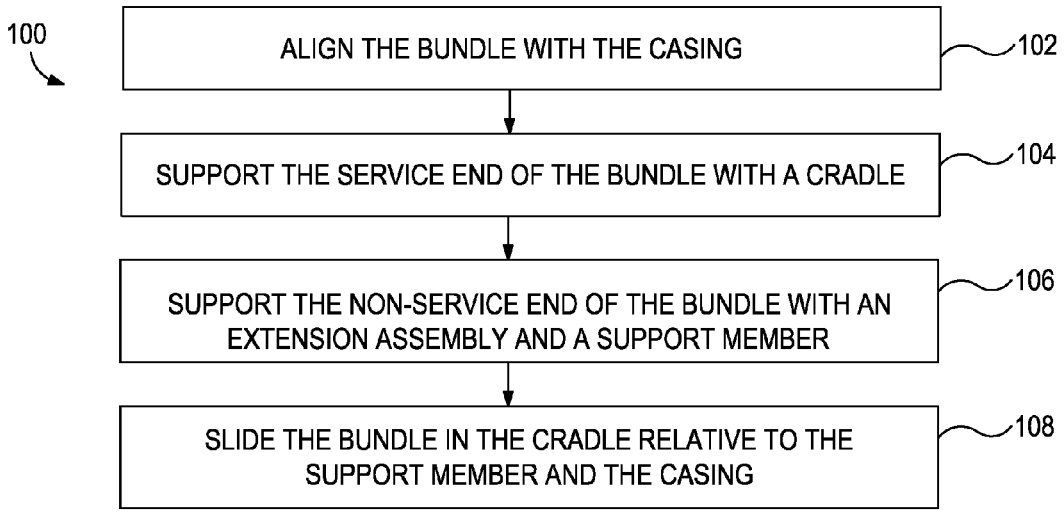
FIG. 23 is a flowchart of an exemplary method for moving a compressor bundle relative to a compressor casing, according to one or more aspects of the disclosure.

FIG. 23 illustrates an exemplary method 100 for moving a compressor bundle relative to a compressor casing, according to an exemplary embodiment. The method 100 may proceed by operation of one or more exemplary embodiments of the compression system 10, or compression systems similar thereto, and thus may be more-fully understood with reference to FIGS. 1-22. In an exemplary embodiment, the method 100 may include aligning the compressor bundle with a service end of the casing such that a non-service end of the compressor bundle faces the service end of the casing, as at 102. This may allow the compressor bundle to be vertically and horizontally positioned such that the bundle can be inserted into the casing through the service end of the casing. The method 100 may also include supporting a service end of the compressor bundle with a cradle, as at 104. The cradle may be attached to the service end of the compressor casing, and may extend therefrom away from a non-service end of the compressor casing. The method 100 may further include supporting the non-service end of the compressor bundle by engaging an extension assembly extending from the non-service end of the bundle with a support member that engages the casing, as at 106. With the bundle supported on both sides, the method 100 may then proceed to sliding the bundle in the cradle relative to the compressor casing and the support member, as at 108.

Figure 24:
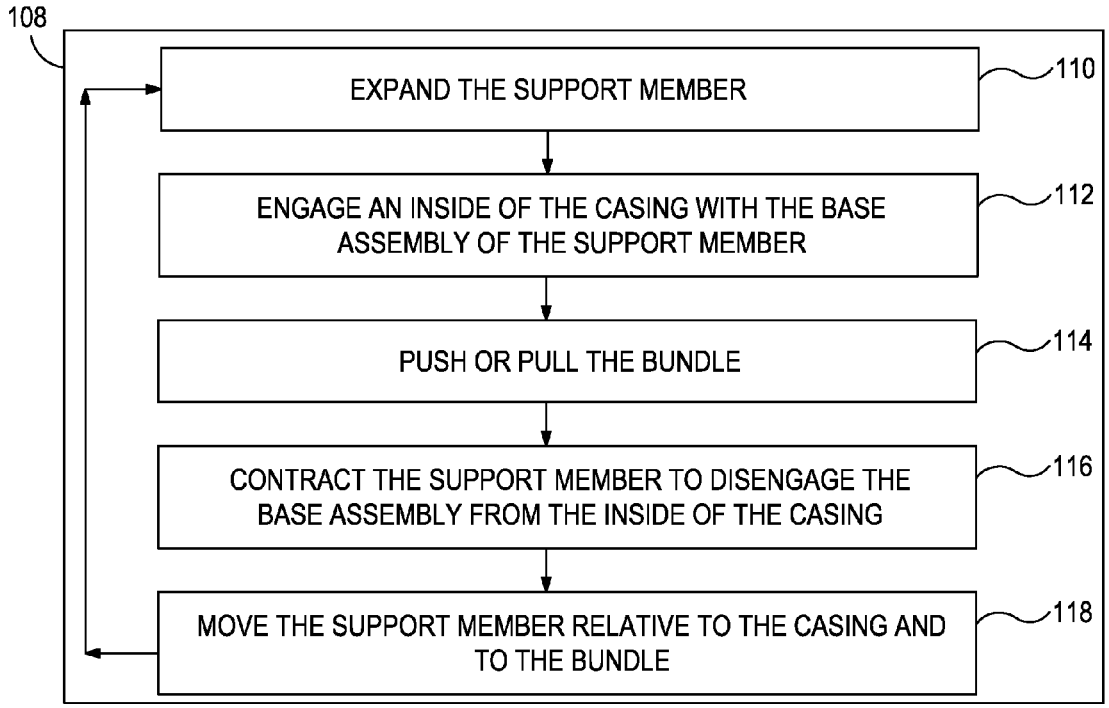
FIG. 24 is a flowchart of an exemplary embodiment of sliding the bundle in the cradle relative to the casing, according to one or more aspects of the disclosure.

FIG. 24 illustrates an exemplary embodiment of sliding the bundle in the cradle relative to the casing, as at 108. Sliding the bundle at 108 may include expanding the support member, as at 110. The expanding may be effected by the support member including a cylinder coupled to a base assembly and to a carrier assembly, with the carrier assembly slidably engaging the extension assembly. The expansion of the cylinder may cause the expanding of the support member at 110. The sliding at 108 may then proceed to engaging an inside of the casing with the base assembly when the support member expands, as at 112. This allows the support member to support the non-service end of the bundle. The bundle may then be pushed into or pulled out of the casing, as at 114. The sliding 108 may then proceed to contracting the support member, specifically, the cylinder, so as to disengage the base assembly from the inside of the casing, as at 116. The sliding at 108 may then proceed to moving the support member relative the casing and the extension assembly, as at 118. This sliding process 108 may then be repeated as necessary, as shown, to incrementally move or "walk" the bundle into or out of the casing.

In another exemplary embodiment, the extension assembly includes a rigid tubular body that extends through the casing from the service end to at least a non-service end of the casing. In such an embodiment, supporting the non-service end of the compressor bundle, as at 106, may include supporting the non-service end of the compressor bundle with a V-block assembly of the support member. For example, the V-block assembly being coupled to the compressor casing proximal the non-service end thereof. Further, during insertion, a segment of the tubular body may be removed, when the segment at least partially extends through the non-service end of the casing.

It is understood that variations may be made in the foregoing without departing from the scope of the disclosure. For example, instead of, or in addition to inserting a bundle into a compressor casing, and extracting the bundle out of the casing, one or more of the above-described exemplary embodiments are used to insert other types of devices or assemblies into other types of casings, and to extract the devices or assemblies out of the casings.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. An insertion/extraction system for a compressor casing and a compressor bundle, comprising:

a cradle extending from a first axial end of the compressor casing and configured to provide support for the compressor bundle during insertion;

an extension assembly coupled to a first axial end of the compressor bundle and extending therefrom into the compressor casing during insertion of the compressor bundle into the compressor casing, during extraction of the compressor bundle from the compressor casing, or both; and a support member that engages the extension assembly and the compressor casing so as to support the first axial end of the compressor bundle via the extension assembly, the support member configured to allow relative movement between the support member and the extension assembly during insertion of the compressor bundle into the compressor casing, extraction of the compressor bundle from the compressor casing, or both.

2. The insertion/extraction system of claim 1, wherein the extension assembly is releasable from the compressor bundle, and both the extension assembly and the support member are removable from the compressor casing when the compressor bundle is inserted into the compressor casing, extracted from the compressor casing, or both.

3. The insertion/extraction system of claim 2, wherein the support member is disposed at least partially within the compressor casing during insertion, extraction, or both.

4. The insertion/extraction system of claim 3, wherein the support member includes:

a carrier assembly engagable with the extension assembly such that the extension assembly and the carrier assembly are moveable relative to each other;

a base assembly engagable with an inside of the compressor casing; and a cylinder engagable with the carrier assembly and the base assembly, the cylinder configured to expand such that the cylinder pushes the base assembly against the inside of the compressor casing and pushes the carrier assembly against the extension assembly to support the first axial end of the compressor bundle, the cylinder further configured to contract to drop the first axial end of the compressor bundle such that the support member is moveable relative to the compressor casing and the extension assembly.

5. The insertion/extraction system of claim 4, wherein:

the extension assembly includes a rigid tubular body coupled to the first axial end of the compressor bundle and a horizontal plate coupled to the tubular body and extending parallel thereto; and the carrier assembly includes a roller that engages the horizontal plate of the extension assembly to allow the extension assembly to move relative to the support member at least when the cylinder is expanded.

6. The insertion/extraction system of claim 4, wherein the base assembly includes an arcuate member shaped complementarily to the inside of the compressor casing, wherein the arcuate member is configured to engage the inside of the compressor casing when the cylinder expands.

7. The insertion/extraction system of claim 6, wherein the base assembly further includes:

a bracket having two sides supporting the carrier assembly and a cross-member extending between at the two sides; and a rod extending through the cross-member and configured to engage the cylinder and the arcuate member when the cylinder expands so as to transmit force between the carrier assembly and the base assembly.

8. The insertion/extraction system of claim 4, further comprising a casing extension coupled to a second axial end of the compressor casing to support the base assembly when the compressor bundle is fully inserted.

9. The insertion/extraction system of claim 1, wherein:

the extension assembly includes a tubular body having a length that is at least as long as a distance between the first axial end and a second axial end of the compressor casing; and the support member includes a support block coupled to the second axial end of the compressor casing, the support block configured to support the tubular body and to allow for relative movement between the support block and the tubular body.

10. The insertion/extraction system of claim 9, wherein the tubular body includes a plurality of tubular segments that are releasably coupled together.

11. The insertion/extraction system of claim 9, wherein the support block comprises a first adjustable V-block assembly.

12. The insertion/extraction system of claim 11, further comprising a second adjustable V-block assembly coupled to the cradle proximal the first axial end of the compressor casing to support the compressor bundle during insertion.

13. The insertion/extraction system of claim 1, further comprising a service end roller assembly coupled to the compressor bundle proximal a second axial end of the compressor bundle, the service end roller assembly configured to engage the cradle to provide moveable support for the compressor bundle on the cradle.

14. A method for moving a compressor bundle relative to a compressor casing, comprising:

aligning the compressor bundle with a service end of the compressor casing such that a non-service end of the compressor bundle faces the service end of the compressor casing;

supporting a service end of the compressor bundle with a cradle;

supporting the non-service end of the compressor bundle by engaging an extension assembly extending from the non-service end of the compressor bundle with a support member that engages the compressor casing; and sliding the compressor bundle in the cradle relative to the compressor casing and the support member.

15. The method of claim 14, wherein sliding the compressor bundle in the cradle relative to the compressor casing and the support member comprises:

expanding the support member by expanding a cylinder thereof, wherein the cylinder is coupled to a base assembly and to a carrier assembly of the support member, wherein the carrier assembly slidably engages the extension assembly;

engaging an inside of the compressor casing with the base assembly when the support member expands so as to support the non-service end of the compressor bundle;

contracting the support member after sliding the compressor bundle so as to disengage the base assembly from the inside of the compressor casing;

moving the support member relative the compressor casing and the extension assembly; and again sliding the compressor bundle in the cradle relative to the compressor casing and the support member.

16. The method of claim 14, wherein:

the extension assembly includes a rigid tubular body extending through the compressor casing from the service end of the compressor casing to at least a non-service end of the compressor casing; and supporting the non-service end of the compressor bundle comprises supporting the non-service end of the compressor bundle with a V-block assembly of the support member, the V-block assembly being coupled to the compressor casing proximal the non-service end thereof.

17. The method of claim 16, further comprising removing a segment of the tubular body when the segment at least partially extends through the non-service end of the compressor casing.

18. A modular compression system, comprising:

a casing having first and second axial ends;

a centrifugal compressor bundle including a service end, a non-service end, and a plurality of compression stages disposed therebetween, the bundle configured to slide into the casing through the first axial end of the casing during insertion and to slide out of the casing through the first axial end during extraction;

a cradle coupled to the casing proximal the first axial end and extending away from the second axial end, the cradle configured to support at least the service end of the centrifugal compressor bundle during insertion, extraction, or both;

a service end roller assembly coupled to the centrifugal compressor bundle proximal the service end, the service end roller assembly configured to roll in the cradle while supporting the centrifugal compressor bundle during insertion, extraction, or both;

a rigid tubular body extending axially from the non-service end of the centrifugal compressor bundle; and a support member configured to engage the casing and the rigid tubular body during insertion, extraction, or both such that the rigid tubular body is moveable relative the support member, the support member being configured to support the non-service end of the centrifugal compressor bundle to substantially prevent the centrifugal compressor bundle from contacting an inside of the compressor casing while the centrifugal compressor bundle is moving during insertion, extraction, or both.

19. The modular compression system of claim 18, wherein the support member comprises:

an arcuate base shaped complementarily to the inside of the casing;

a carrier assembly disposed at least partially above the arcuate base and including one or more rollers configured to support the rigid tubular body such that the centrifugal compressor bundle is moveable relative the support member; and a hydraulic cylinder engaging the arcuate base and the carrier assembly, the hydraulic cylinder configured to expand such that the arcuate base bears on the inside of the casing so as to support the non-service end of the centrifugal compressor bundle and to contract such that the support member is moveable relative to the casing and the centrifugal compressor bundle.

20. The modular compression system of claim 18, wherein:

the support member includes an adjustable V-block assembly coupled to the casing proximal the second axial end; and the rigid tubular body extends through the casing and out of the second axial end during insertion, extraction, or both, wherein the rigid tubular body includes a plurality of tubular segments releasably coupled together such that as the rigid tubular body extends out of the second axial end.

* * * * *